US007080591B2

(12) United States Patent
Doherty

(10) Patent No.: US 7,080,591 B2
(45) Date of Patent: Jul. 25, 2006

(54) NON-SYMMETRICAL SEAL PLATE AND VALVE HOUSING

(75) Inventor: James Doherty, Feeding Hills, MA (US)

(73) Assignee: Hamilton Sundstrand, Windsor Locks, CT (US)

( * ) Notice: Subject to any disclaimer, the term of this patent is extended or adjusted under 35 U.S.C. 154(b) by 172 days.

(21) Appl. No.: 10/940,923

(22) Filed: Sep. 14, 2004

(65) Prior Publication Data

US 2006/0054014 A1 Mar. 16, 2006

(51) Int. Cl.
*F15B 13/04* (2006.01)

(52) U.S. Cl. ..... 91/448

(58) Field of Classification Search ..... 91/444, 91/448; 137/625.66, 625.69
See application file for complete search history.

(56) References Cited

U.S. PATENT DOCUMENTS 3,411,411 A * 11/1968 Fleck et al. ..... 91/448
5,325,669 A * 7/1994 Barker et al. ..... 91/444
6,792,965 B1 * 9/2004 Kunkler ..... 137/625.69

* cited by examiner

*Primary Examiner*—Edward K. Look
*Assistant Examiner*—Michael Leslie
(74) *Attorney, Agent, or Firm*—Carlson, Gaskey & Olds

(57) ABSTRACT

A hydraulic assembly has a first fluid valve and a second fluid valve. A switching valve having a first fluid input and a second fluid input also has a fluid output. The first fluid input is in fluid communication with the first fluid valve while the second fluid input is in fluid communication with the second fluid valve. The switching valve is configured to switch fluid communication to the fluid output between the first fluid input and the second fluid input. A fluid actuator is in fluid communication with the fluid output. A housing for the switching valve is provided. The housing has a first portion and a second portion. The first portion has a first fluid passage permitting fluid communication between the first fluid valve and the first fluid input and a second fluid passage permitting fluid communication between the second fluid valve and the second fluid input. The first fluid passage has a first opening and the second fluid passage has a second opening. The second portion has a first seal to seal the first opening and a second seal to seal the second opening.

20 Claims, 3 Drawing Sheets

NON-SYMMETRICAL SEAL PLATE AND VALVE HOUSING

The U.S. Government has a paid-up license in this invention and the right in limited circumstances to require the patent owner to license others on reasonable terms as provided by the terms of Government Contract No. N00019-02-C-3003 awarded by the Navy.

BACKGROUND OF THE INVENTION

This invention relates to a Non-symmetrical worm seal plate and valve housing for a vehicle, such as an aircraft.

A hydraulic system for an aircraft may be used to control operation of the aircraft's systems. For example, the raising and lowering of wing flaps, the opening and closing of on-board doors, and the control of delivery of fuel to the engine may all involve a hydraulic system. The hydraulic system has an actuator that controls operation of each of these features. Given the critical nature of these systems, they may be provided with redundancies to prevent complete system failure if any part of the system fails. Consequently, it is not unusual for a hydraulic system to have duplicate components to take over a function of a failed component.

In particular, it is common to have redundant valves that control fluid flow to the actuator of the hydraulic system. Fluid lines within a machined housing pass from each of these valves to the actuator piston. Another valve, such as a switching valve, controls the communication of fluid from each of the valves to the actuator so that if one fails, the switching valve reroutes fluid flow from the other valve to the actuator.

These redundant components may be identical to minimize system cost. Due to this similarity, the fluid lines to each of these components cross over. This crossing over of lines contributes greatly to the overall size and weight of the unit.

In the past, these fluid lines were created by drilling multiple passages to form a complex network of lines. These lines were plumbed through the housing of the valves. To form an elbow shaped line in the housing required the drilling of two holes, one hole for each line extending from the elbow. Because two holes had to be drilled through the housing, one for each line, one was required to be plugged to ensure correct fluid flow through the elbow. These plugs add further weight and cost to the assemblies.

A need therefore exists for a hydraulic assembly that allows the crossover of fluid lines without additional weight or cost.

SUMMARY OF THE INVENTION

The invention comprises a Non-symmetrical worm seal plate and a valve housing hydraulic assembly having a first fluid valve and a second fluid valve. A switching valve has a first fluid input and a second fluid input as well as a fluid output. The first fluid input is in fluid communication with the first fluid valve while the second fluid input is in fluid communication with the second fluid valve. The switching valve is configured to switch fluid communication to the fluid output between the first fluid input and the second fluid input. A fluid actuator is in communication with the fluid output.

A housing houses the switching valve. The housing has a first portion and a second portion. The first portion has a first fluid passage permitting fluid communication between the first fluid valve and the first fluid input while a second fluid passage permits fluid communication between the second valve and the second fluid input. The first fluid passage has a first opening while the second fluid passage has a second opening. The second portion of the housing has a first seal to seal the first opening and a second seal to seal the second opening.

Accordingly, a valve is disposed in the housing. The housing assembly has a first body (Valve Housing) and a second body (Non-symmetrical worm seal plate). A fluid passage is created along an axis in the first body through an opening. In addition, a first fluid passage inlet is created to direct fluid to the first fluid passage along a first direction transverse to the axis. A first fluid passage outlet is created to direct fluid from the first fluid passage to the valve. The opening is sealed by the second body.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
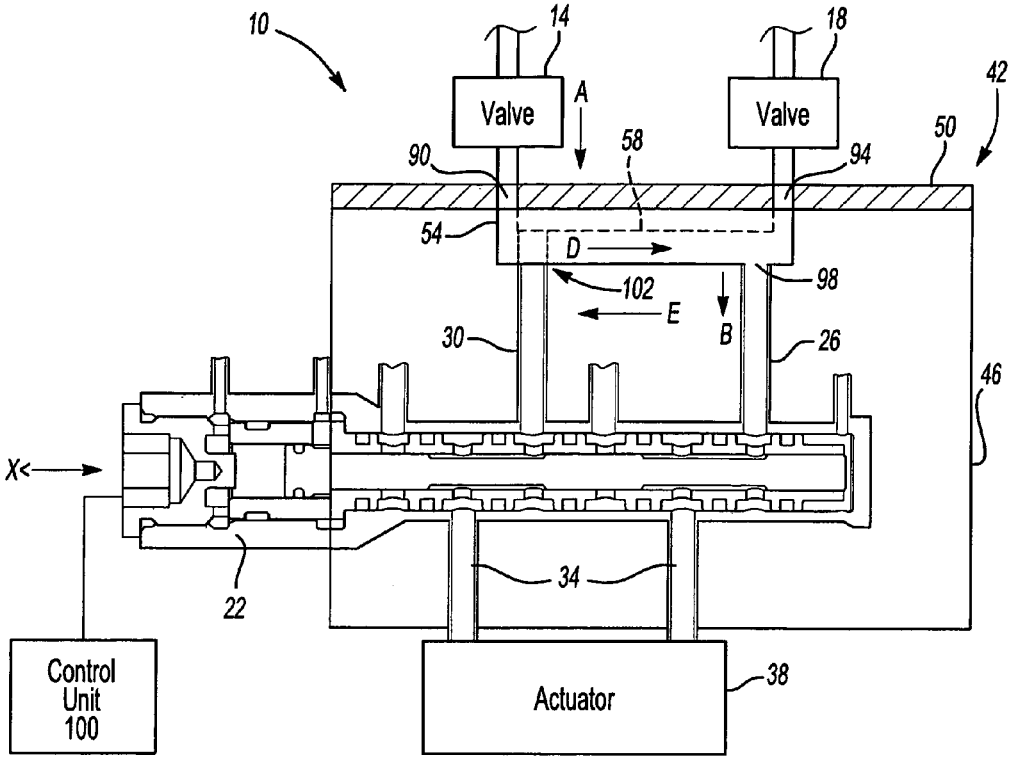
FIG. 1 illustrates a side view of the inventive hydraulic assembly, including valve housing, non-symmetrical worm seal plate, and valves, and actuator.

FIG. 1 illustrates a side cross-sectional view of hydraulic assembly 10. Like existing systems, hydraulic assembly 10 has first fluid valve 14 and second fluid valve 18, switching valve 22, and actuator 38. Switching valve 22 is housed within housing 42. Second fluid valve 18 is a redundant component of first fluid valve 14. First fluid valve 14 is accordingly substantially similar, if not identical to, second fluid valve 18. Either first fluid valve 14 or second fluid valve 18 controls the flow of fluid ultimately to actuator 38. First fluid valve 14 and second fluid valve 18 may be electro-hydraulic servo valves. Switching valve 22 is provided to determine which valve, either first fluid valve 14 or second fluid valve 18, will provide fluid to actuator 38. As known, actuator 38 may control the operation of various hydraulic systems on a vehicle, such as an aircraft. For example, actuator 38 may control the opening and closing of doors, the operation of aircraft flaps, and the delivery of fuel. First fluid valve 14 may be the default valve used to direct fluid to actuator 38. In the event first fluid valve 14 fails, switching valve 22 closes off fluid communication of first fluid valve 14 to actuator 38 and allows second fluid valve 18 to communicate fluid to actuator 38. In this way, like existing systems, hydraulic assembly 10 provides redundancy against system failure.

Figure 2:
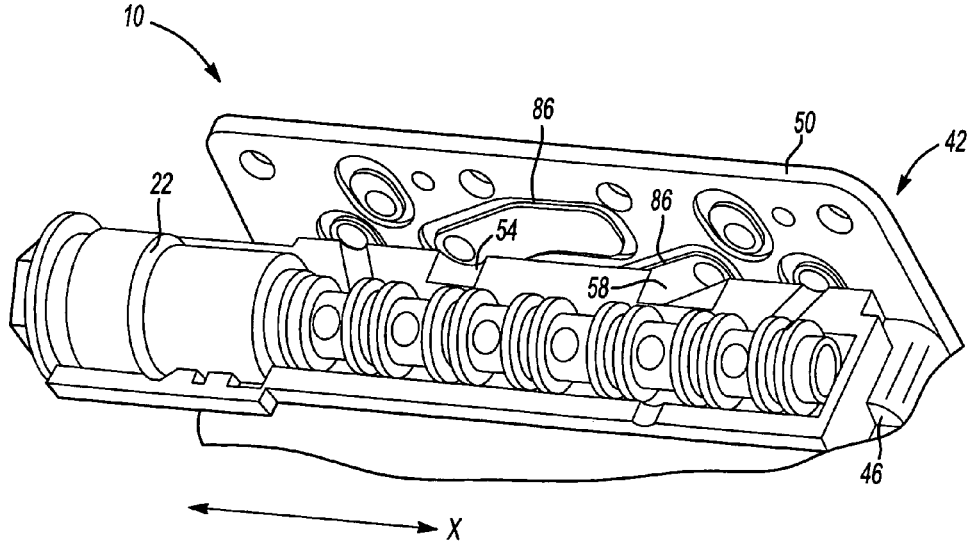
FIG. 2 is perspective cross-sectional view of the hydraulic assembly of FIG. 1, illustrating fluid passages and seals.
Figure 4:
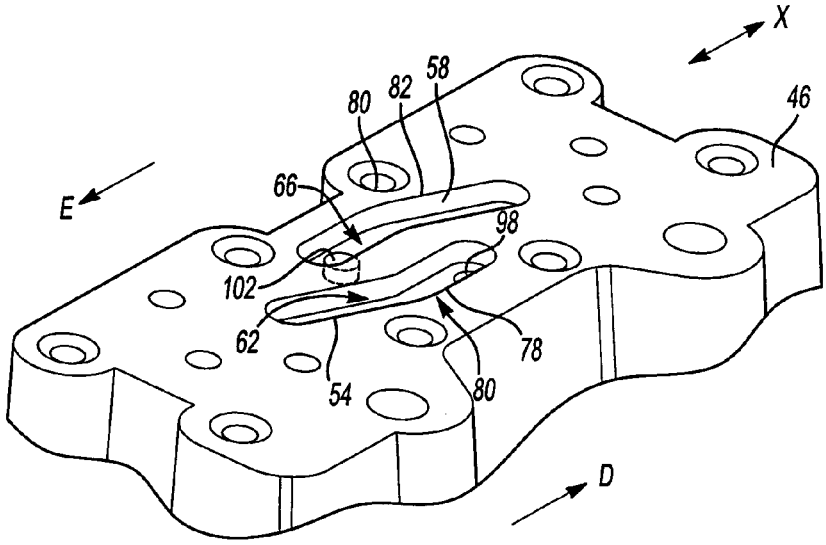
FIG. 4 illustrates another portion of the housing of the inventive hydraulic assembly of FIGS. 1–3.

In contrast to existing assemblies, however, hydraulic assembly 10 has a unique housing 42 having first portion 46 and second portion 50. As shown in FIGS. 2 and 4, first portion 46 has first fluid passage 54 and second fluid passage 58 formed along axis X as shown in FIG. 1 and FIG. 4. This is the same axis upon which switching valve 22 generally extends. Accordingly, first fluid passage 54 and second fluid passage 58 are created in first portion 46 to allow fluid to be passed along the axis X of switching valve 22. As shown in FIG. 4, first fluid passage 54 and second fluid passage 58 may not directly route fluid across the X axis but may deviate from this axis. Hence, as shown in FIG. 4, first fluid passage 54 and second fluid passage 58 have bends 80.

Figure 3:
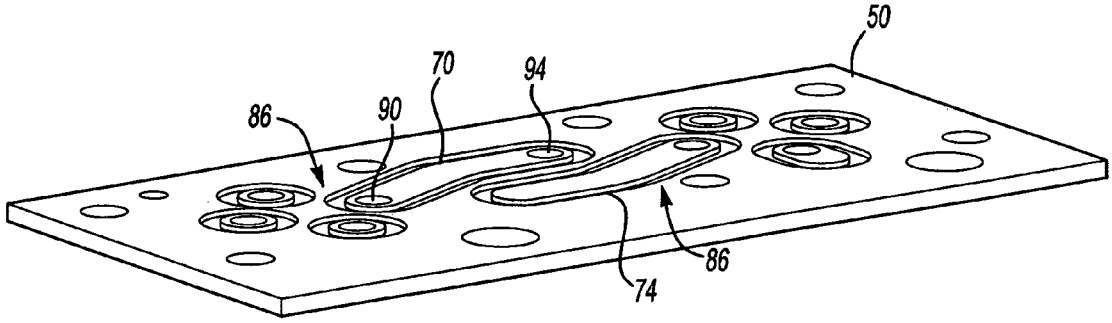
FIG. 3 illustrates the non-symmetrical worm seal plate.

As shown in FIG. 4, first fluid passage 54 and second fluid passage 58 are channels formed in first portion 46 of housing 42. As explained in greater detail, first fluid passage 54 and second fluid passage 58 may be formed by machining or milling first portion 46 generally along the X axis. First opening 62 of first fluid passage 54 and second opening 66 of second fluid passage 58 are thereby formed. Because first opening 62 and second opening 66 are formed, they must be sealed. Accordingly, FIG. 3 shows second portion 50 having first seal 70 and second seal 74 shaped similarly to first opening 62 and second opening 66, respectively. FIG. 3 shows second portion 50 flipped over from the position it occupies on top of first portion 46. This is to illustrate the shape of first seal 70 and second seal 74. As shown, first seal 70 and second seal 74 are disposed within grooves 86 in second portions 50, here a plate.

As shown in FIG. 4, first opening 62 has periphery 78 that extends around first opening 62 while second opening 66 has periphery 82 that extends around second opening 66. First seal 70 is shaped to seal periphery 78 of first opening 62 while second seal 74 is shaped to seal periphery of second opening 66. Hence, when second portion 50 is placed over first portion 46 so that first seal 70 engages periphery 78 of first opening 62 and second seal 74 engages periphery 82 of second opening 66, second portion 50 thereby seals first fluid passage 54 and second fluid passage 58 of first portion 46. Second portion 50 may be attached to first portion 46 by bolts, screws or other known fasteners to ensure a tight seal. In this way, a portion of housing 42 serves to seal multiple openings resulting from the creation of first fluid passage 54 and second fluid passage 58. Hence, no additional plugs or sealing components are required, thereby reducing the cost and weight of the assembly. Moreover, forming fluid passages in this manner permits greater freedom in the shape of the passages. These fluid passages may be routed in any desired manner. One need not be constrained by the straight lines created by drill holes to form fluid passages but may form fluid passages of any shape within first portion 46. In this way, first fluid passage 54 and second fluid passage 58 may be allowed to overlap in first portion 46 say along the X axis as shown in FIG. 1 and FIG. 4.

As shown in FIGS. 1 and 3, to communicate fluid from first fluid valve 14 and second fluid valve 18 to first fluid passage 54 and second fluid passage 58, respectively, second portions 50 is provided with first fluid passage inlet 90 and second fluid passage inlet 94. First fluid passage inlet 90 is a hole that extends through second portion 50 and is disposed within first seal 70. Second fluid passage inlet 94 is also a hole and is disposed within second seal 74.

As shown in FIG. 1, fluid from first fluid valve 14 passes through first fluid passage inlet 90 of second portion 50 along the direction of arrow A, a direction transverse to the X axis. The fluid is then transported through first fluid passage 54 to first fluid passage outlet 98, a hole drilled into first portion 46 of housing 42. First fluid passage outlet 98 is in fluid communication with switching valve 22 through first fluid input 26. Fluid passes in the direction of arrow D along the X axis to first fluid passage outlet 98 and down in the direction of arrow B, a direction transverse to the X axis, to switching valve 22. Fluid is then passed to actuator 38 through fluid output 34.

Similarly, in the event of the failure of first fluid valve 14, as seen in FIG. 1, fluid passes from second fluid valve 18 through second fluid passage inlet 94, a hole, then as shown in FIG. 4 through second fluid passage 58 in the direction of arrow E to second fluid passage outlet 102, a hole drilled in second fluid passage 58 to second fluid input 30 (shown in FIG. 1). Switching valve 22 controls fluid flow to actuator 38 through fluid output 34 through control unit 100 as known.

Figure 5:
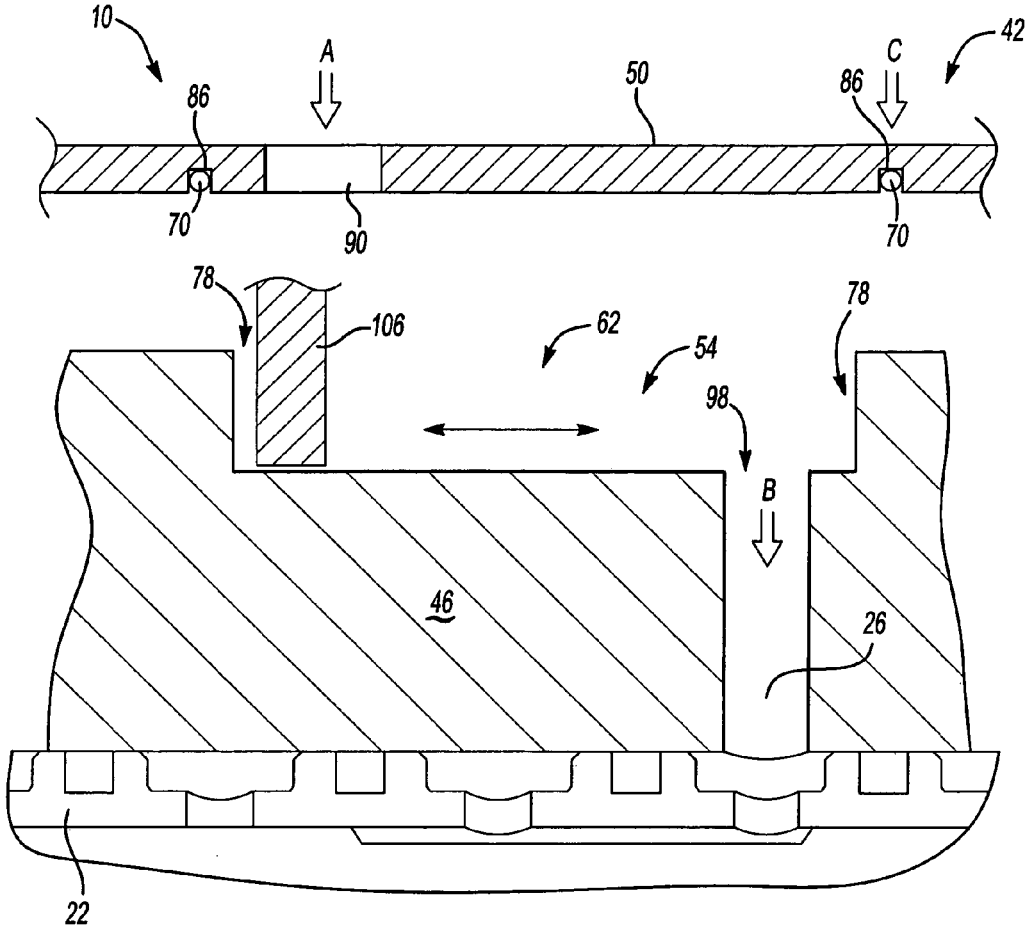
FIG. 5 illustrates the inventive technique used to create the hydraulic assembly of FIGS. 1–4.

The technique for manufacturing hydraulic assembly 10 will now be explained with reference to FIG. 5. As shown, housing 42 houses switching valve 22. Switching valve 22 is disposed within first portion 46. First portion 46 is machined by mill 106. Mill 106 mills across the X axis to form first fluid passage 54. First fluid passage inlet 90 is formed in second portion 50 to permit fluid flow in the direction of arrow A into first fluid passage 54. In addition, displaced from first fluid passage inlet 90 along the X axis is first fluid passage outlet 98, which directs fluid flow in a direction transverse to the X axis along the direction of arrow B. First fluid passage 54 is formed with first opening 62 having periphery 78. First seal 70, which is shaped to extend around the periphery 78, is disposed within groove 86 of second portion 50. When seal 70 is aligned over first opening 62 such that it extends around periphery 78, second portion 50 is then brought down on top of first portion 46 in the direction of arrow C as shown so that second portion 50 covers first opening 62 and first seal 70 seals periphery 78 of first opening 62.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A hydraulic assembly comprising:

a first fluid valve;

a second fluid valve;

a switching valve having a first fluid input, a second fluid input and a fluid output, said first fluid input in fluid communication with said first fluid valve and said second fluid input in fluid communication with said second fluid valve;

said switching valve configured to switch fluid communication to said fluid output between said first fluid input and said second fluid input;

a fluid actuator in fluid communication with said fluid output;

a housing for said switching valve, said housing having a first portion and a second portion;

said first portion having a first fluid passage permitting fluid communication between said first fluid valve and said first fluid input and a second fluid passage permitting fluid communication between said second fluid valve and said second fluid input, said first fluid passage having a first opening and said second fluid passage having a second opening; and said second portion having a first seal to seal said first opening and having a second seal to seal said second opening.

2. The hydraulic assembly of claim 1 wherein said switching valve extends generally along an axis, said first fluid passage and said second fluid passage extending generally parallel to said axis.

3. The hydraulic assembly of claim 2 wherein said first fluid passage and said second fluid passage overlap.

4. The hydraulic assembly of claim 1 wherein at least one of said first seal and said second seal extends along a periphery of one of said first opening and said second opening.

5. The hydraulic assembly of claim 4 wherein said second portion has a groove to accommodate said one of said first seal and said second seal.

6. The hydraulic assembly of claim 1 wherein said second portion has a first fluid passage inlet permitting fluid communication to said first fluid passage and a second fluid passage inlet permitting fluid communication to said second fluid passage.

7. The hydraulic assembly of claim 6 wherein said first fluid passage inlet is smaller than said first opening of said first portion.

8. The hydraulic assembly of claim 6 wherein said first fluid passage has a first fluid passage outlet in fluid communication with said first fluid passage inlet and said second fluid passage has a second fluid passage outlet in fluid communication with said second fluid passage inlet, said first fluid passage outlet in fluid communication with said first fluid input and said second fluid passage outlet in fluid communication with said second fluid input.

9. The hydraulic assembly of claim 8 wherein said first fluid passage extends generally along an axis, said first fluid passage inlet configured to permit fluid communication in a first direction transverse to said axis and said first fluid passage inlet displaced along said axis from said first fluid passage outlet.

10. The hydraulic assembly of claim 1 wherein said first valve is substantially similar to said second valve.

11. A hydraulic assembly comprising:

a housing having a first portion and a second portion;

a first fluid passage disposed in said first portion, said first fluid passage having a first opening and a first fluid passage outlet; and said second portion having a first seal to seal a periphery of said first opening and having a first fluid passage inlet in fluid communication with said first fluid passage, said first fluid inlet disposed within said periphery.

12. The hydraulic assembly of claim 11 including a valve disposed in said housing, said first fluid passage in fluid communication with said valve through said first fluid passage outlet.

13. The hydraulic assembly of claim 12 including a second fluid passage in fluid communication with said valve, said second fluid passage having a second opening and said second portion having a second seal to seal a periphery of said second opening.

14. The hydraulic assembly of claim 11 wherein said first fluid passage extends generally along an axis, said first fluid passage inlet displaced along said axis from said first fluid passage outlet and configured to direct fluid communication along a direction transverse to said axis.

15. The hydraulic assembly of claim 14 wherein said first opening extends along said axis from said first fluid passage inlet to said first fluid passage outlet.

16. The hydraulic assembly of claim 15 wherein said second portion extends to cover said first opening along said axis at least between said first fluid passage inlet and said first fluid passage outlet.

17. A method of manufacturing a valve assembly, comprising the steps of:

disposing a valve in a housing, the housing having a first body and a second body;

creating a first fluid passage along an axis in the first body through an opening;

creating a first fluid passage inlet to direct fluid communication to the first fluid passage along a first direction transverse to the axis;

creating a first fluid passage outlet to direct fluid communication from the first fluid passage to the valve; and sealing the opening with the second body.

18. The method of manufacturing of claim 17 wherein the first fluid passage inlet is displaced from the first fluid passage outlet along the axis.

19. The method of manufacturing of claim 17 wherein the first fluid passage directs fluid communication along a second direction transverse to the axis.

20. The method of manufacturing the valve assembly of claim 19 wherein creating comprises machining along the axis.

* * * * *